US007412940B2

(12) United States Patent
Kemmer et al.

(10) Patent No.: US 7,412,940 B2
(45) Date of Patent: Aug. 19, 2008

(54) COVER AND METHOD FOR CONSTRUCTING SAME

(75) Inventors: Walter T. Kemmer, Phoenix, AZ (US); Jerry W. Kimball, Mesa, AZ (US); Michael T. Welch, Chandler, AZ (US)

(73) Assignee: Westland Industries, Inc., Vonore, TN (US)

( * ) Notice: Subject to any disclaimer, the term of this patent is extended or adjusted under 35 U.S.C. 154(b) by 17 days.

(21) Appl. No.: 11/345,856

(22) Filed: Feb. 1, 2006

(65) Prior Publication Data

US 2007/0175379 A1 Aug. 2, 2007

(51) Int. Cl.
*B63B 17/02* (2006.01)
*B65D 65/02* (2006.01)

(52) U.S. Cl. ..... 114/361; 150/166

(58) Field of Classification Search ..... 114/361
See application file for complete search history.

(56) References Cited

U.S. PATENT DOCUMENTS 2,570,533 A * 10/1951 Elliott ..... 150/166
3,491,388 A * 1/1970 Bareis ..... 114/361

OTHER PUBLICATIONS

Shown in Exhibit A is a picture of a prior art boat cover having a cone design connected to a movable piece located under the cover.

Shown in Exhibit B is a picture of a prior art boat cover having a flap wrappable about an accessory item to form a cone shape.

Shown in Exhibit C is a picture from the perspective of the rear port side of the boat.

Shown in Exhibit D is a picture from the perspective of the rear starboard side of the boat.

Shown in Exhibit E is a picture from the perspective of the front starboard side of the boat.

Shown in Exhibit F is a picture from the front port side of the boat.

* cited by examiner

*Primary Examiner*—Jesús D Sotelo
(74) *Attorney, Agent, or Firm*—Dunlap Codding, P.C.

(57) ABSTRACT

An assembly including a boat and a cover. The cover covers and protects the boat. The boat is provided with one or more covered portion, and one or more uncovered portion. The cover includes a protective covering, and a boot. The protective covering defines a tolerance cut out adapted to receive a portion of the one or more uncovered portion when the protective covering is covering the object. The tolerance cut out has a length, a width and a perimeter. The boot is provided with an upstanding material flange, and a sealing system. The upstanding material flange extends about the perimeter of the tolerance cut out so as to define an opening aligned with the tolerance cut out, the upstanding material flange extends upwardly from the protective covering. The sealing system is positioned upstream of the tolerance cut out and on the upstanding material flange for sealing the upstanding material flange along the length of the tolerance cut out.

20 Claims, 6 Drawing Sheets

COVER AND METHOD FOR CONSTRUCTING SAME

CROSS-REFERENCE TO RELATED APPLICATIONS

Not applicable.

STATEMENT REGARDING FEDERALLY SPONSORED RESEARCH AND DEVELOPMENT

Not applicable.

BRIEF DESCRIPTION OF THE SEVERAL VIEWS OF THE DRAWINGS

So that the above recited features and advantages of the present invention can be understood in detail, a more particular description of the invention, briefly summarized above, may be made by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
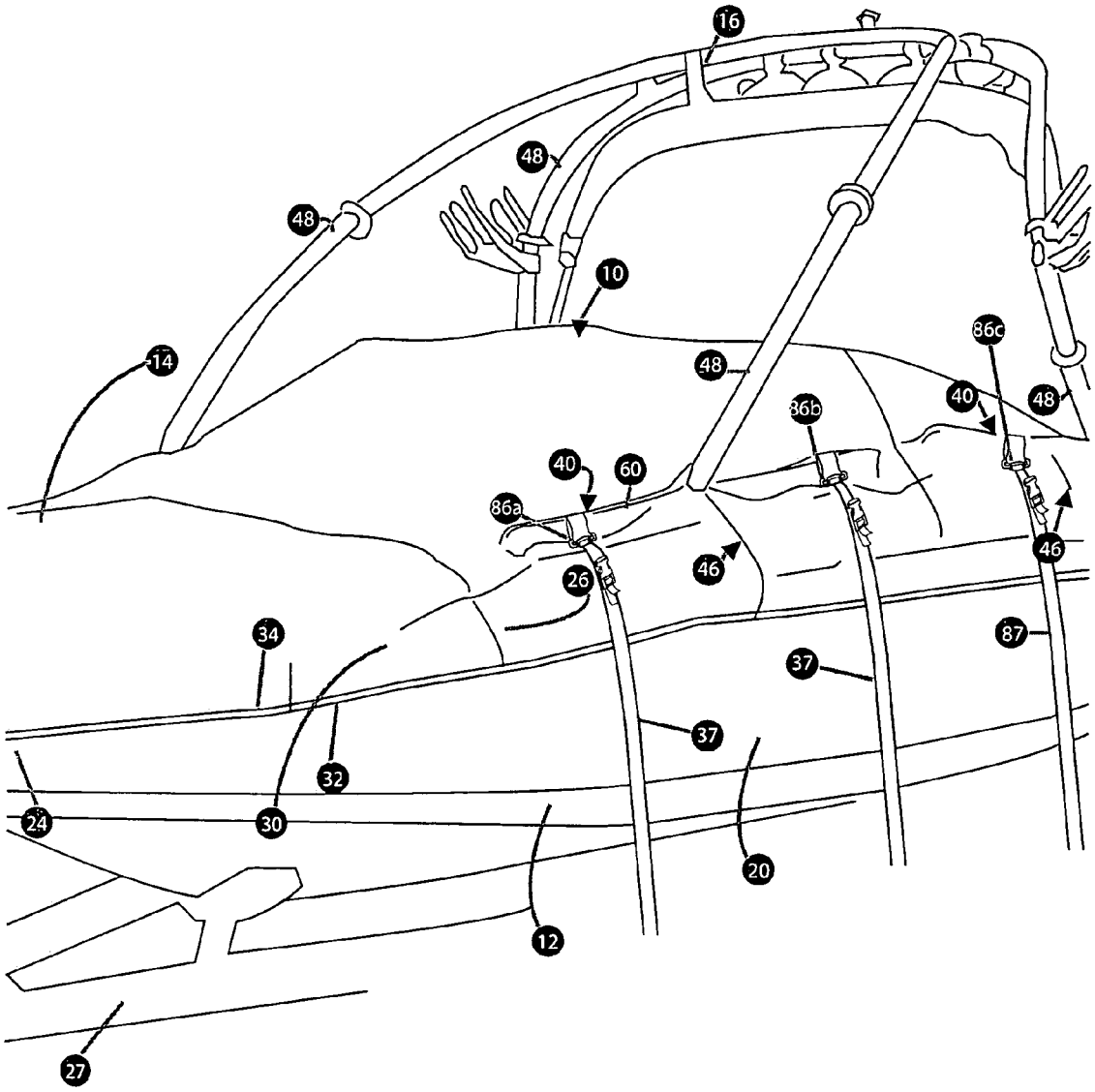
FIG. 1 is a front perspective view of one version of a cover constructed in accordance with the present invention positioned on and attached to a boat having covered portions covered by the cover and uncovered portions uncovered by the cover.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Referring now to the drawings, and in particular to FIG. 1, shown therein and designated by a reference numeral 10 is a preferred embodiment of a cover constructed in accordance with the present invention shown in a secured position over an object 12. The object 12 is provided with one or more covered portion 14, and one or more uncovered portion 16. The covered portion 14 of the object 12 is any part of the object 12 which is covered by the cover 10 and thereby protected by the cover 10. The one or more uncovered portion 16 is any part of the object 12 extending outwardly from the cover 10 so as to be uncovered and not protected by the cover 10. In a preferred embodiment, the object 12 is a boat, such as a ski boat, fishing boat, yacht, personal watercraft or other type of watercraft. In this regard, the remainder of the patent application will describe a particular use of the cover 10 for covering and protecting covered portions 14 of the boat 12. Examples of covered portions 14 of the boat 12 include center console(s), seat(s), deck(s), trolling motor(s), cockpit area(s), inboard engine(s), outboard engine(s), windshield(s) or the like. It should be understood that the cover 10 can be constructed and adapted for protecting other types of objects 12, such as poling platform, t-tops, and swim decks.

The boat 12 has a hull 20, a stern 22, and a bow 24. The hull 20 is formed generally with a gunnell 26 on each side. A trailer 27 is provided for transporting the boat 12.

The cover 10 includes a protective covering 30 extending across a top of the boat 12 and also extending down over the gunnell 26 from bow 24 to stern 22. The protective covering 30 is provided with a peripheral edge 32, which typically is defined by a peripheral folded seam 34 formed around the edge of the protective covering 30. The cover 10 is maintained on the boat 12 via any suitable assembly or device, such as one or more drawstrings 36 (see FIG. 5A) threaded through the peripheral folded seam 34 so that the protective covering 30 can be drawn tightly around the hull 20 below the gunnell 26. A suitable form of slide lock (not shown) can then be secured to cinch the drawstrings 36 tightly around the hull 20. In another example, tie down devices 37, such as strings, straps, bungee cords or the like can be attached to the cover 10, and the boat 12 or the trailer 27 for maintaining the protective covering 30 on the boat 12.

The protective covering 30 can be formed of any material or device capable of being extended over the covered portions 14 of the boat 12 so as to protect the covered portions 14. For example, the protective covering 30 can be constructed of a flexible material, such as canvas, vinyl or the like with the primary function of the protective covering 30 being to isolate the covered portions 14 of the boat 12 from damaging influences such as insects, rodents, sunlight and inclement weather.

The cover 10 is also provided with a boot 40 adapting the cover 10 into a virtually universal option for fitting the cover 10 to similar boats 12 such that the covered portions 14 of the boats 12 are covered while the uncovered portions 16 are left uncovered. In one preferred embodiment, the boot 40 is provided with a sealing system 42 (see FIG. 3) solving an industry problem for aftermarket and original equipment manufacturer dealer installations of uncovered portions 16 of boats 12, including but not limited to ski towers, pylons, biminis, radar arches, flagpoles, or the like that are provided or travel outside the standard coverage areas, i.e., the covered portions 14, of the boats 12. The uncovered portion 16 of the boat 12 can be referred to hereinafter as "accessory item"

Figure 3:
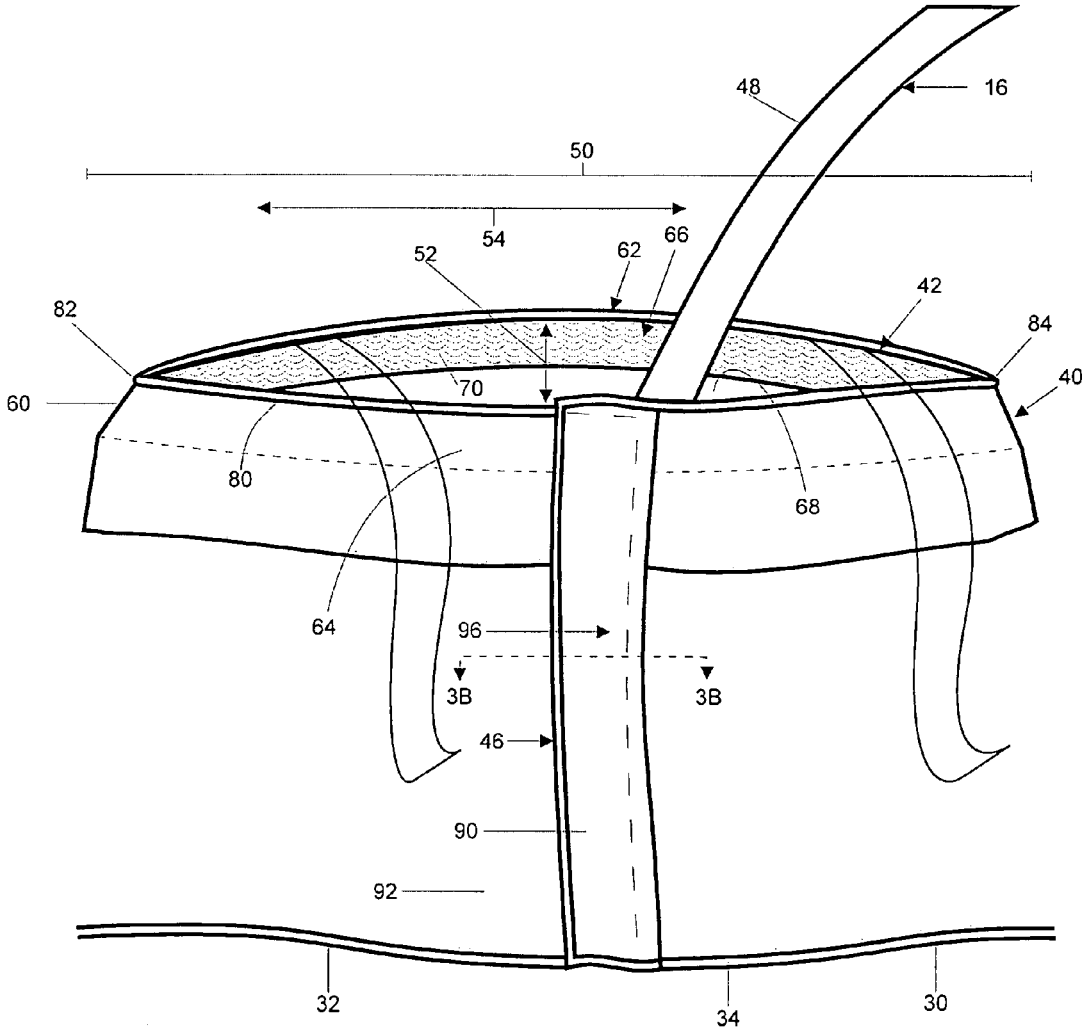
FIG. 3 is a perspective view of one version of a boot constructed in accordance with the present invention forming a part of the cover depicted in FIG. 1.
Figure 3A:
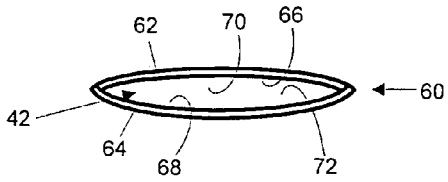
FIG. 3A is a top plan view of an example of an upstanding material flange constructed in accordance with the present invention.

As best shown in FIG. 3, the boot 40 permits the protective covering 30 to cover the boat 12 even though the boat 12 can be provided with a variety of different types of accessory items 16. In general, the boot 40 defines or surrounds a tolerance cut out 44 (see FIG. 5A) formed within the protective covering 30. To permit the accessory item 16 to be positioned within and removed from the tolerance cut out 44, the protective covering 30, and the boot 40 cooperate to define a passageway 46 extending generally from the peripheral edge 32 of the protective covering 30 to the tolerance cut out 44 in the protective covering 30. In one preferred embodiment, the boot 40 is mounted under or over the protective covering 30 and connected to the protective covering 30 in any suitable manner, such as by sewing, riveting, gluing, chemical welding, or the like.

Figure 2:
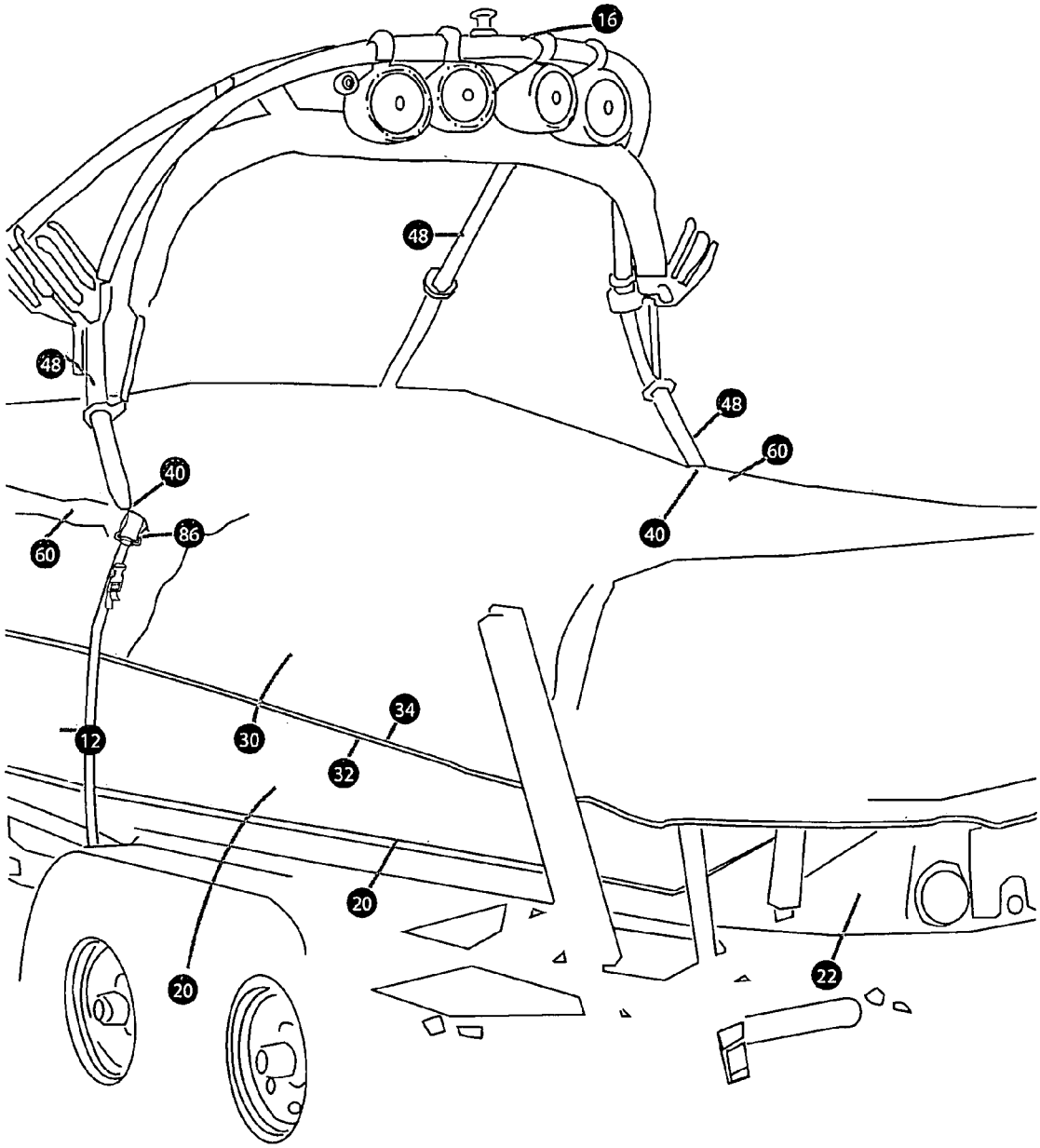
FIG. 2 is a rear perspective view of the cover and boat depicted in FIG. 1.

Referring again to FIGS. 1 and 2, in one preferred embodiment, the cover 10 is provided with more than one boot 40. For example, in the embodiment of the cover 10 depicted in FIG. 1, the cover 10 is provided with four boots 40, tolerance cut outs 44, and passageways 46. In general, the cover 10 is provided with one boot 40, tolerance cut out 44, and passageway 46 for each part of the accessory item 16 extending generally beyond the cover 10. For example, when the accessory item 16 is a bimini, as depicted in FIG. 1, the accessory item 16 is provided with four supports 48 connected to the boat 12. In the example depicted in FIG. 1, the cover 10 is provided with four boots 40, tolerance cuts outs 44, and passageways 46 with each passageway 46 designed to provide access for one support 48 into the tolerance cut out 44 and for each boot 40 to seal around one support 48 utilizing the sealing system 42.

As shown in FIG. 3, the boot 40 is provided with a length 50 and a width 52. The length 50 extends generally parallel to an axis 54 extending between the stern 22 and the bow 24 of the boat 12. The width 52 extends generally transverse to the axis 54. Although the example of the boot 40 depicted in FIG. 1 has the length 50 extending generally parallel to the axis 54, and the width 52 extending generally perpendicular to the axis 54, it should be understood that the angle between the length 50 and width 52 extending relative to the axis 54 can be varied depending on the desires of the designer. For example, the length 50 can extend generally diagonally with respect to the axis 54. The length 50 is provided with a magnitude much larger than the expected size of the support 48 to be surrounded so as to provide for variation of the fit of the boot 40 about the support 48 of the accessory item 16. In one preferred embodiment, the length 50 is at least four times larger than a cross-sectional length of the support 48 to be surrounded by the boot 40. Likewise, the width 52 can be much larger than the expected cross-sectional width of the support 48 or other portion of the uncovered portion 16 designed to be surrounded by the boot 40. For example, in the example depicted in FIG. 1, the width 52 is approximately 2-3 times greater than the cross-sectional width of the support 48. Although the tolerance cut out 46 has been shown and described as having an elliptical or oblong shape, it should be understood that the shape of the tolerance cut out 46 can be varied to manage up and down and side variations.

In one preferred embodiment, the boot 40 is provided with an upstanding material flange 60 that extends about the perimeter of the tolerance cut out 44 and also surrounds the accessory item 16 positioned within the tolerance cut out 44 regardless of the position of the accessory item 16 within the tolerance cut out 44. In this embodiment, the sealing system 42 is connected to the upstanding material flange 60 upstream of the tolerance cut out 44 and serves to surround the accessory item 16 fore and aft and seal around the accessory item so as to reduce, and hopefully prevent water from intruding past the sealing system 42 to protect the covered portions 14 of the boat 12 from such water infiltration. The upstanding material flange 60 is provided with opposing sides 62 and 64 with each side 62 and 64 having an inner surface 66 and 68 upon which the sealing system 42 is attached. The sealing system 42 is provided with a first attachment member 70 and a second attachment member 72. The first attachment member 70 can be removably connected to the second attachment member 72 along the length of the first and second attachment members 70 and 72. In one preferred embodiment, the first attachment member 70 is constructed of a hook type material, and the second attachment member 72 is constructed of a loop type material. For example, the first attachment member 70 and the second attachment member 72 can be constructed of a hook and loop system sold under the trademark VELCRO®. Although the first attachment member 70 and the second attachment member 72 will be described herein as the hook and loop type materials, it should be understood that the sealing system 42 can be provided with any type interconnecting devices. For example, the first and second attachment members 70 and 72 can be constructed of respective portions of zippers, straps, buckles, zip-lock seals, reusable adhesive tapes, snaps, magnets, clips, ropes, elastic material and combinations thereof.

The oblong shape of the tolerance cut out 44 and the upstanding material flange 60 of the boot 40 manages up and down and side to side variation with respect to the locations of the accessory item(s) 16.

As shown in FIG. 3, the upstanding material flange 60 is provided with an upper edge 80. The upstanding material flange 60 has a first end 82 and a second end 84 with the upper edge 80 extending generally therebetween. The upper edge 80 can be provided with a curvature or radius near the first end 82 and the second end 84 to allow for water to run away from the upper edge 80 of the upstanding material flange 60. However, it should be understood that the upper edge 80 of the upstanding material flange 60 can be provided with other shapes, such as an elliptical shape, or a conical shape so as to permit water to run off the upper edge 80 of the upstanding material flange 60.

As an optional feature, the covering 30 is provided with a plurality of tie-down connectors 86. Only three of the tie-down connectors 86 are shown in FIG. 1 and labeled with the reference numerals 86*a*, 86*b* and 86*c* for purposes of clarity. In a preferred embodiment, one of the tie down connectors 86 is supported by the protective covering 30 in close proximity (e.g., within several inches) to the first end 82 of the upstanding material flange 60, and another one of the tie down connectors 86 is supported by the protective covering 30 in close proximity (e.g., within several inches) to the second end 84 of the upstanding material flange 60. In an even more preferred embodiment, one of the tie down connectors 86 extends from the first end 82 of the upstanding material flange 60, and another one of the tie down connectors 86 extends from the second end 84 of the upstanding material flange 60. Thus, when the protective covering 30 is provided with four boots 40, then the protective covering 30 is preferably also provided with at least eight tie-down connectors 86. The tie down devices 37 are connected to the tie-down connectors 86 and also connected to the boat 12 or the trailer 27 for securing the protective covering 30 to the boat 12.

The tie-down connectors 86 are preferably formed of a piece of 1 inch web material forming a loop. In this instance, the web material has each end secured to the upstanding material flange 60 or the protective covering 30 or combinations thereof to form the loop. However, it should be understood that the tie-down connectors 86 can be constructed of any device suitable for mating or connecting with the tie-down devices 37. For example, the tie-down connectors 86 can be constructed of hooks, loops, clasps, or the like.

Figure 3B:
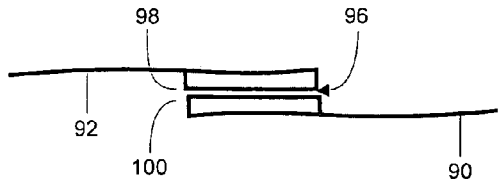
FIG. 3B is a partial cross-sectional view of the protective covering taken along the lines 3B-3B depicted in FIG. 3.

As discussed above, the protective covering 30 and the boot 40 cooperate to form the passageway 46 to provide access to the tolerance cut out 44. The passageway 46 is defined by opposing sides 90 and 92 of the protective covering 30. To selectively close and open the passageway 46, the cover 10 is provided with an attachment assembly 96 extending from the tolerance cut out 44 to the peripheral edge 32. As best shown in FIG. 3B, the attachment assembly 96 is provided with a first passageway attachment member 98 and a second passageway attachment member 100. The first passageway attachment member 98 is designed to be removably connected to the second passageway attachment member 100 along the length of the first and second passageway attachment members 98 and 100. In one preferred embodiment, the first passageway attachment member 98 is constructed of a hook type material, and the second passageway attachment member 100 is constructed of a loop type material. For example, the first passageway attachment member 98 and the second passageway attachment member 100 can be constructed of a hook and loop system sold under the trademark VELCRO®. Although the first passageway attachment member 98 and the second passageway attachment member 100 will be described herein as the hook and loop type materials, it should be understood that the sealing system 42 can be provided with any suitable type of interconnecting devices. For example, the first and second passageway attachment members 98 and 100 can be constructed of respective portions of zippers, straps, buckles, zip-lock seals, reusable adhesive tapes, snaps, magnets and combinations thereof.

The upstanding material flange 60 can be connected to the protective covering 30 in any suitable manner. For example, the upstanding material flange can be constructed separately from the protective covering 30 and mounted either under the protective covering 30, or over the protecting covering 30 so long as the upstanding material flange 60 surrounds the tolerance cut out 44 and extends upwardly from the protective covering 30 so as to minimize the likelihood that water will intrude into the tolerance cut out 44 from the upstanding material flange. It should also be understood that the upstanding material flange and the protective covering can be constructed of the same or different types of material. For example, the upstanding material flange 60 can be constructed of a plastic material, while the protective covering 30 is constructed of a canvas material. In another preferred embodiment, the upstanding material flange 60 and the protective covering 30 are both constructed out of canvas type material.

Figure 4A:
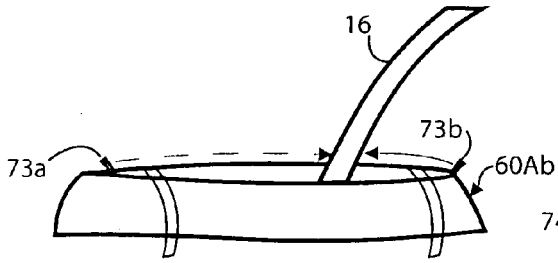
FIG. 4A is a perspective view of another embodiment of a sealing system constructed in accordance with the present invention.
Figure 4B:
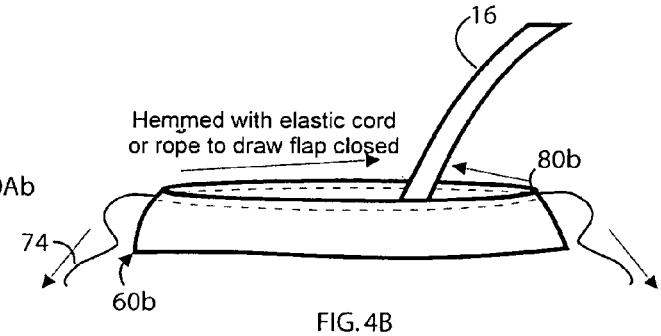
FIG. 4B is a perspective view of another embodiment of a sealing system constructed in accordance with the present invention.
Figure 4C:
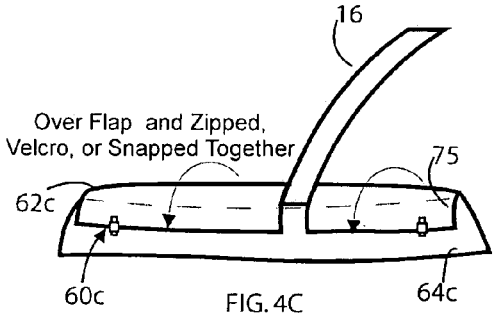
FIG. 4C is a perspective view of another embodiment of a sealing system constructed in accordance with the present invention.
Figure 4D:
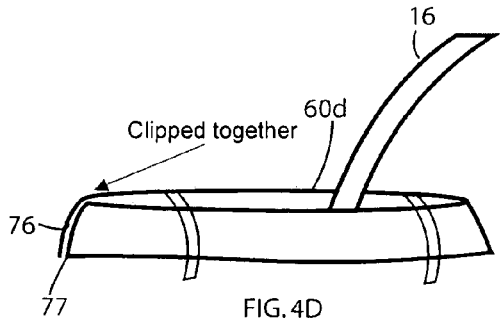
FIG. 4D is a perspective view of another embodiment of a sealing system constructed in accordance with the present invention.
Figure 4E:
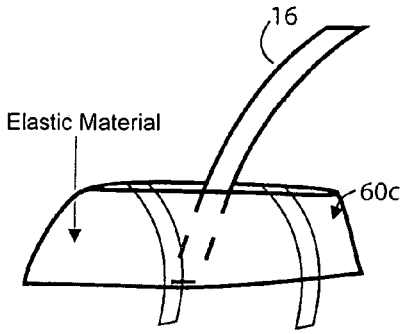
FIG. 4E is a perspective view of another embodiment of a sealing system constructed in accordance with the present invention.
Figure 4F:
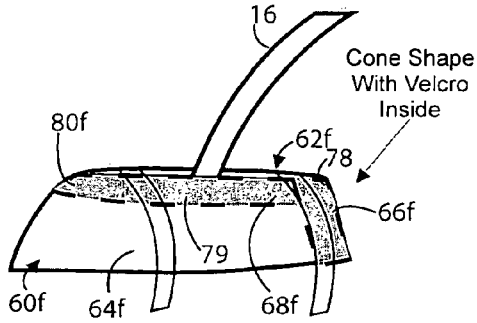
FIG. 4F is a perspective view of another embodiment of a sealing system constructed in accordance with the present invention.

Referring to FIGS. 4A-4F, various embodiments of the sealing system 42 of the upstanding material flange 60 are shown. It should be understood that the upstanding material flanges 60*a-f*, shown in FIGS. 4A-4F, are substantially identical to the upstanding material flange 60 in construction with the exception of the following as discussed herein. As shown in FIG. 4A, an upstanding material flange 60*a* is provided with a pair of zippers 73*a* and 73*b*. The zippers 73*a* and 73*b* are utilized for surrounding the accessory item 16. Shown in FIG. 4B, an upstanding material flange 60*b* is shown with a rope 74 hemmed about an upper edge 80*b* for drawing the upstanding material flange 60*b* about the accessory item 16. Shown in FIG. 4C, an over flap 75 extends from a side 62*c* of an upstanding material flange 60*c*. A passageway 76 is formed in the over flap 75 for receiving the accessory item 16 when the over flap 75 is moved to come into contact with an opposing side 64*c*. The over flap 75 may be connected to the opposing side 64*c* with a zipper, snap, magnet, hook and loop material, buckle, strap, reusable adhesive tapes, zip-lock seals, or the like. Shown in FIG. 4D, two opposing open ends 76 and 77 of an upstanding material flange 60*d* are connected together with a clip (not shown) for surrounding the accessory item 16. Referring to FIG. 4E, an upstanding material flange 60*e* constructed from an elastic material is shown in accordance with the present invention so as to surround the accessory item 16. It should be understood that any elastomer may be utilized, such as rubbers, synthetic rubbers, or the like so long as the elastomer functions in accordance with the present invention. Shown in FIG. 4F, an upper edge 80*f* of an upstanding material flange 60*f* is constructed in a cone-shape. Hook and loop material 78 and 79 is positioned along inner surfaces 66*f* and 68*f* of a first side 62*f* and a second side 64*f* for providing a seal about the accessory item 16.

Figure 5A:
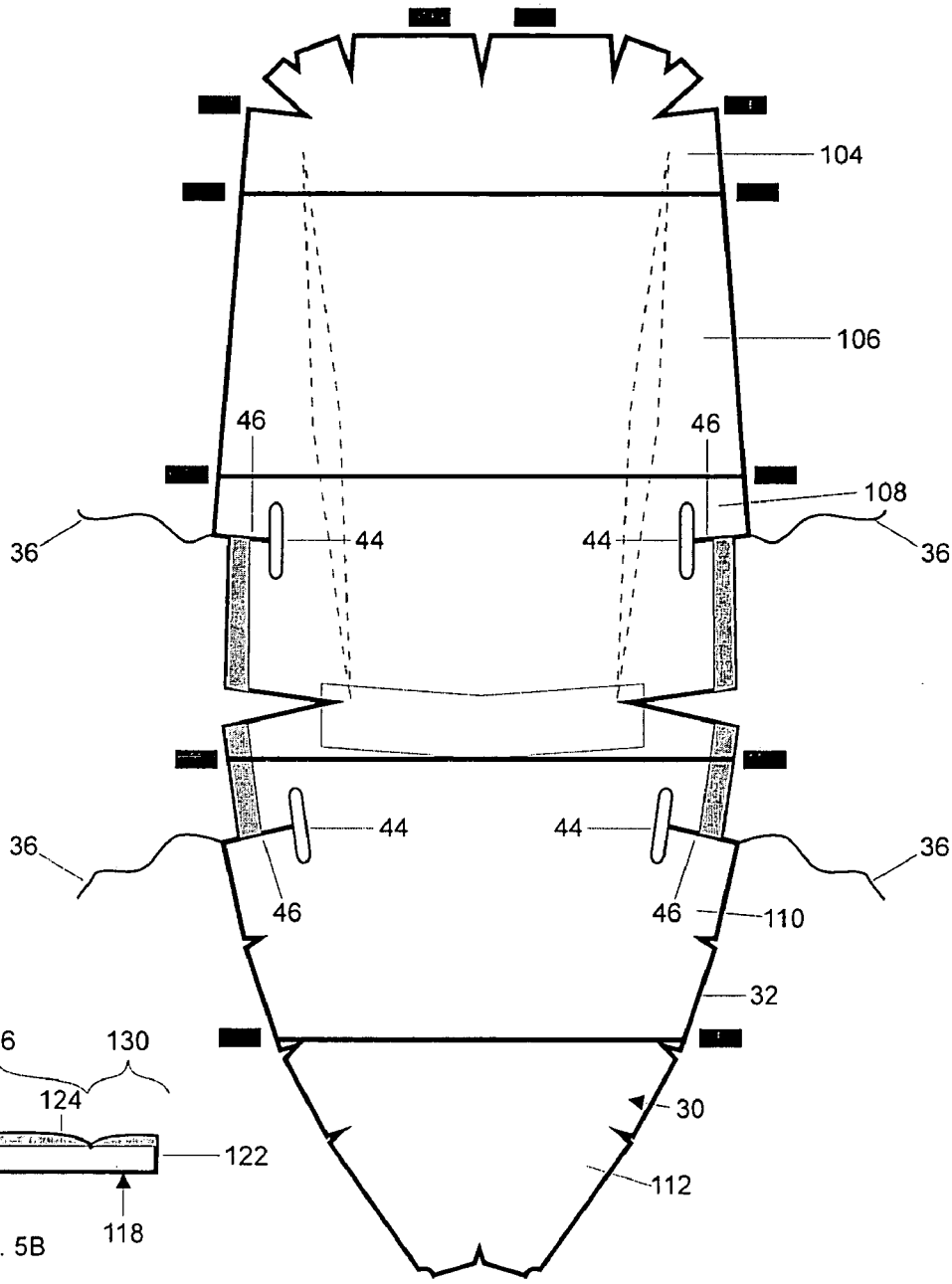
FIG. 5A is a top plan view illustrating the construction of one version of a protective covering forming part of the cover depicted in FIG. 1.
Figure 5B:
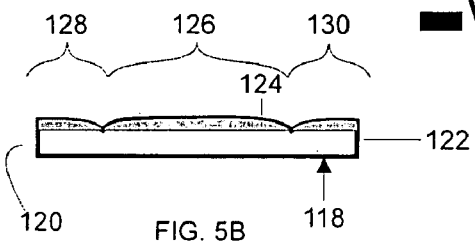
FIG. 5B is a top plan view illustrating one version of a flap utilized to form the boot depicted in FIG. 3.

FIG. 5A is a top plan view illustrating the construction of one version of the protective covering 30. The protective covering 30 can be constructed of one piece of material, or two or more interconnected pieces of material. For example, as shown in FIG. 5A, the protective covering 30 is constructed from five pieces of material 104, 106, 108 110 and 112 connected at their respective edges. The peripheral edge 32 of the protective covering 30 is shaped to correspond to the shape of the boat 12 to be covered by, for example, cutting V-shaped wedges into the peripheral edge 32 of the protective covering 30 and closing the V-shaped wedges by sewing or the like. The protective covering 30 is provided with one or more of the tolerance cut outs 44, and passageways 46. FIG. 5B is a top plan view illustrating one version of a flap 118 utilized to form the upstanding material flange 60 of the boot 40 depicted in FIG. 3. The flap 118 is provided with a first end 120, a second end 122, and an upper edge 124 extending therebetween. The flap 118 can be characterized as having an inner or medial portion 126, and a pair of lateral portions 128 and 130. The inner or medial portion 126 forms the side 62 of the upstanding material flange 60, and the pair of lateral portions 128 and 130 cooperate to form the other side 64 of the upstanding material flange 60 when the flap 118 is mounted to the protective covering 30. As best shown in FIG. 3, when the flap 118 is mounted to the protective covering 30, the first end 120 of the flap is generally aligned with the opposing side 92 of the protective covering 30 forming the passageway 46, while the second end 122 of the flap 118 is generally aligned with the other opposing side 90 of the protective covering 30 forming the passageway 46. The upper edge 124 of the flap 118 has a scalloped shape so as to form the upper edge 80 of the upstanding material flange 60 with a curvature or radius near the first end 82 and the second end 84 to allow for water to run away from the upper edge 80 of the upstanding material flange 60.

Figure 6:
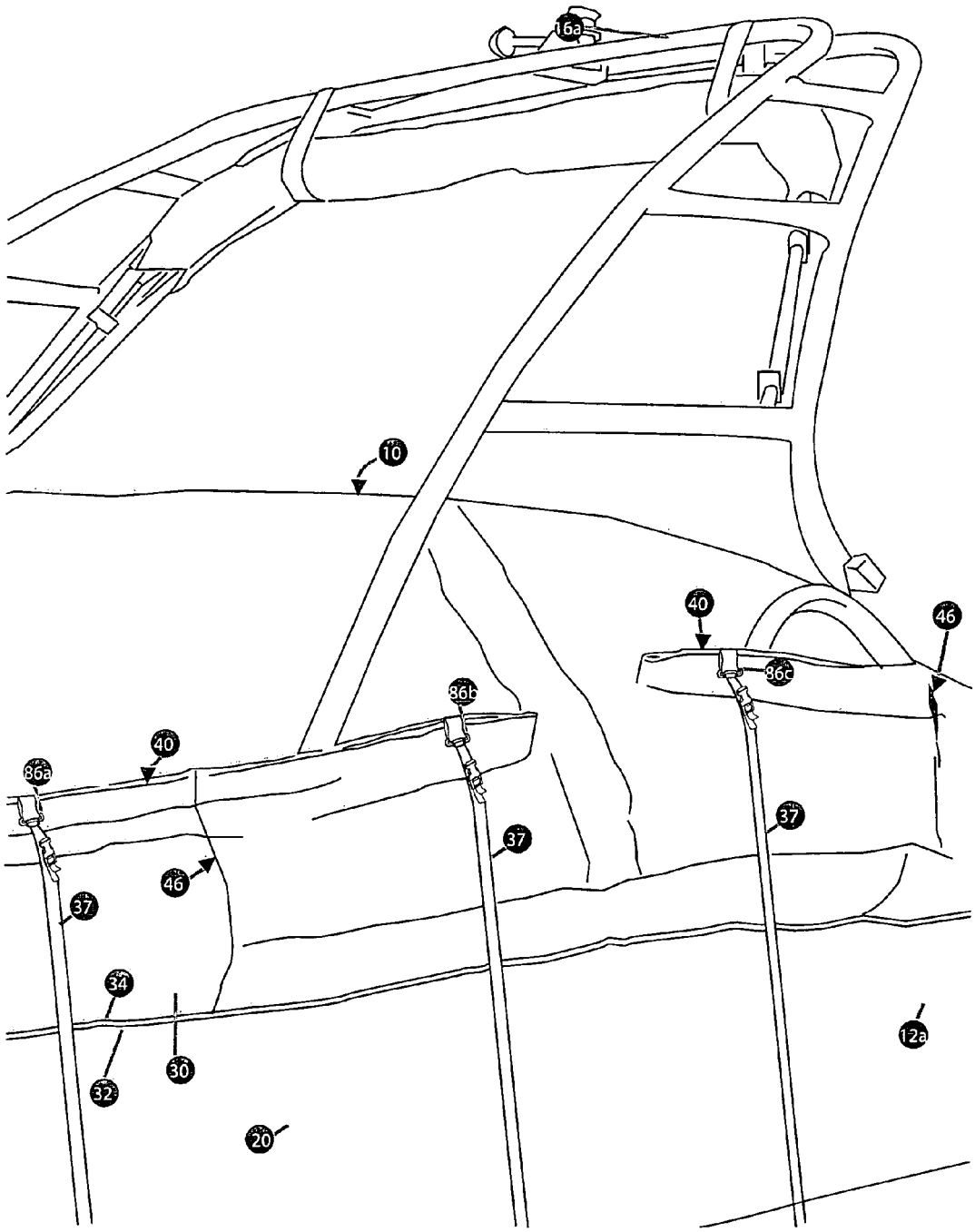
FIG. 6 is a perspective view of the cover positioned on and attached to another version of a boat.

FIG. 6 is a perspective view of the cover 10 positioned on and attached to another version of a boat 12*a*. The boat 12*a* is similar to the boat 12, except that the boat 12*a* has an accessory item 16*a* with a rear support structure 48*a* formed as an elongated U-shape having two portions surrounded and sealed by the boot 40.

To cover or protect the boat 12 or 12*a*, the protective covering 30 is extended across the boat 12 or 12*a* to generally cover the boat 12 or 12*a*. One of the passageways 46 is opened, and portion(s) of the accessory item(s) 16 are passed through the passageway 46 and into one of the tolerance cut outs 44 such that the accessory item(s) 16 extend(s) through the tolerance cut out 44. Then, the sealing system 42 of the boot 40 is used to seal along the length of the tolerance cut out 44 to form a seal about the portions of the accessory item(s) 16 positioned within the tolerance cut out 44. This procedure is then repeated for each of the four boots 40, tolerance cuts outs 44, and passageways 46 of the cover 10. Then, the cover is secured to the boat 12 by tightening the one or more drawstrings 36 to draw the protective covering tightly around the hull 20 below the gunnell 26. A suitable form of slide lock (not shown) can then be secured to cinch the drawstrings 36 tightly around the hull 20. In another example, strings, straps, bungee cords or the like can be used for attaching the cover 10 to the boat 12 or the trailer 27.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A cover for covering and protecting an object provided with a covered portion, an uncovered portion, the cover comprising:

a protective covering defining a tolerance cut out adapted to receive the uncovered portion when the protective covering is covering the object, the tolerance cut out having a length, a width and a perimeter; and a boot comprising:

an upstanding material flange extending about the perimeter of the tolerance cut out so as to define an opening aligned with the tolerance cut out to receive and extend around the uncovered portion, the upstanding material flange extending upwardly from the protective covering and having a height less than the uncovered portion such that the uncovered portion extends upwardly past the upstanding material flange when the uncovered portion is positioned within the opening; and a sealing system positioned upstream of the tolerance cut out and on the upstanding material flange for sealing the upstanding material flange along the length of the tolerance cut out to seal around the uncovered portion at an arbitrary position within the opening.

2. The cover of claim 1, wherein the length of the tolerance cut out exceeds the width of the tolerance cut out.

3. The cover of claim 1, wherein the object is a boat, and wherein the protective covering is shaped to cover a top side of the boat.

4. The cover of claim 1, wherein the upstanding material flange includes a first end, a second end and an upper edge extending therebetween, the upper edge having an arcuate shape.

5. The cover of claim 1, wherein the upstanding material flange includes a first end, a second end and an upper edge extending therebetween, the upper edge having a curvature near the first end and the second end.

6. The cover of claim 1, wherein the protective covering is constructed of a flexible material.

7. The cover of claim 1, wherein the upstanding material flange includes opposing sides with each side having an inner surface upon which the sealing system is attached.

8. The cover of claim 7, wherein the sealing system comprises a first attachment member and a second attachment member, the first attachment member being removably connected to the second attachment member along the length of the first and second attachment members.

9. The cover of claim 1, wherein the upstanding material flange includes a first end, and wherein the cover further comprises a tie-down connector positioned in close proximity to the first end of the upstanding material flange.

10. An assembly, comprising:

a boat; and a cover for covering and protecting one or more covered portions of the boat, the boat further provided with an uncovered portion extending outwardly from the cover, the cover comprising:

a protective covering defining a tolerance cut out receiving the uncovered portion, the tolerance cut out having a length, a width and a perimeter; and a boot comprising:

an upstanding material flange extending about the perimeter of the tolerance cut out so as to define an opening aligned with the tolerance cut out receiving and extending around the uncovered portion, the upstanding material flange extending upwardly from the protective covering and having a height less then the uncovered portion such that the uncovered portion extends outwardly from the upstanding material flange; and a sealing system positioned upstream of the tolerance cut out and on the upstanding material flange for sealing the upstanding material flange along the length of the tolerance cut out to seal around the uncovered portion at an arbitrary position within the opening.

11. The assembly of claim 10, wherein the length of the tolerance cut out exceeds the width of the tolerance cut out.

12. The assembly of claim 10, wherein the protective covering is shaped to cover a top side of the boat.

13. The assembly of claim 10, wherein the upstanding material flange includes a first end, a second end and an upper edge extending therebetween, the upper edge having an arcuate shape.

14. The assembly of claim 10, wherein the upstanding material flange includes a first end, a second end and an upper edge extending therebetween, the upper edge having a curvature near the first end and the second end.

15. The assembly of claim 10, wherein the protective covering is constructed of a flexible material.

16. The assembly of claim 10, wherein the upstanding material flange includes opposing sides with each side having an inner surface upon which the sealing system is attached.

17. The assembly of claim 16, wherein the sealing system comprises a first attachment member and a second attachment member, the first attachment member being removably connected to the second attachment member along the length of the first and second attachment members.

18. The assembly of claim 10, wherein the upstanding material flange includes a first end, and wherein the cover further comprises a tie-down connector positioned in close proximity to the first end of the upstanding material flange.

19. A method for covering a boat, comprising the steps of:

covering the boat with a protective covering having a tolerance cut out with an uncovered portion of the boat extending through the tolerance cut out and in an arbitrary position within the tolerance cut out; and sealing along the length of the tolerance cut out to form a seal about the uncovered portion positioned in the arbitrary position within the tolerance cut out.

20. The method of claim 19, wherein the protective covering is defined further to include a passageway extending from a periphery of the protective covering to the tolerance cut out, and wherein the method further comprises the step of passing the uncovered portion of the boat through the passageway to position the uncovered portion of the boat within the tolerance cut out.

* * * * *